United States Patent [19]

Chinchar

[11] Patent Number: 4,825,733

[45] Date of Patent: May 2, 1989

[54] MULTI-LEVERAGE, VARIABLE HANDLING TWIST TURN WRENCH

[76] Inventor: Victor M. Chinchar, 2287 Clague Rd., Westlake, Ohio 44145

[21] Appl. No.: 101,843

[22] Filed: Sep. 28, 1987

[51] Int. Cl.[4] ..... B25B 13/00

[52] U.S. Cl. ..... 81/177.2; 81/177.5; 81/177.1

[58] Field of Search ..... 81/177.2, 177.1, 177.5, 81/489, 124.7, 177.8, 177.9, 177.7, 177.85, 121.1, 124.3, 124.6

[56] References Cited

U.S. PATENT DOCUMENTS

| | | | |
|---|---|---|---|
| 1,095,851 | 5/1914 | Grafton | 81/489 |
| 1,177,604 | 4/1916 | Cowell | 81/177.8 |
| 1,578,114 | 3/1926 | Fegley | 81/177.5 |

FOREIGN PATENT DOCUMENTS

| | | | |
|---|---|---|---|
| A061463 | 5/1955 | France | 81/177.6 |

*Primary Examiner*—Frederick R. Schmidt
*Assistant Examiner*—Lawrence Cruz
*Attorney, Agent, or Firm*—Donald A. Bergquist

[57] ABSTRACT

This invention relates to wrenches, specifically to wrenches commonly known as socket wrenches, and it comprises an improved versatile wrench handle and shaft to be used in conjunction with standard removable sockets and ratchets for speedily and conveniently loosening or tightening nuts or bolts by itself or with the application of other wrenches as needed, each operated by the same person or with the assistance of one or more persons. The invention comprises a 'D'-shaped handle with provisions made for applying torque to the wrench handle by various means, the selection of which means is dependent upon the means most appropriate and convenient for the task to be performed.

10 Claims, 1 Drawing Sheet

MULTI-LEVERAGE, VARIABLE HANDLING TWIST TURN WRENCH

INTRODUCTION

This invention relates to wrenches, specifically to wrenches commonly known as socket wrenches, and it comprises an improved versatile wrench handle and shaft to be used in conjunction with standard removable sockets and ratchets for speedily and conveniently lossening or tightening nuts or bolts by itself or with the application of other wrenches as needed, each operated by the same person or with the assistance of one or more persons. The invention comprises a 'D'-shaped handle with provisions made for applying torque to the wrench handle by various means, the selection of which means is dependent upon the means most appropriate and convenient for the task to be performed.

The invention is that of a unique and novel all purpose drive handle for sockets of the type used in performing mechanical work on automobiles, machinery, equipment of all types, and any assemblies of metal, wood, plastic, and other materials, which assemblies are assembled with nuts, bolts, screws, or plugs that are used to hold such assemblies and parts together.

One novel feature of this drive is that it provides a variety of ways by which it can be turned by one or more persons. It also provides for a variety of ways by which it can be cooperatively held, operated, and manipulated by one or more persons at the same time. It also provides for a variety of ways by which it can be used to apply torque for either loosening or tightening threaded fasteners by one or more persons as required working cooperatively.

Another feature of this drive is that it provides easy-to-control centralized hold on nuts, bolts, screws, plugs, etc., so as to minimize any angular resistance and turning stress of the threaded fastener being turned. Another feature of this drive is that it permits the user to exert firm forward pushing and holding power to maximize the hold of a socket on nuts, bolts, screws, plugs, etc., and to minimize possible turning slip-off. In this mode of use, the wrench of this invention provides for the user a high degree of torque sensitivity not attained by using standard socket wrench drive handles. Yet another feature of this drive handle is that it provides for numerous utilization of individual or combinations of socket wrench and prybars, ratchets, open end wrenches, box wrenches, and leverage bars as well as utilizing any type of long bar handles for leverage needed to turn nuts, bolts, screws, plugs, and even drills.

DISCUSSION OF THE PRIOR ART

The use of 'D'-shaped handles for tools for applying torque is rare in the patent literature. U.S. Pat. No. 1,411,365, issued to Mitchell, shows a wrench including a D handle referred to as a ". . . hand-hold freely mounted on said shank whereby said hand-hold and shank are capable of independent rotation . . . ." The main thrust of the Mitchell patent appears to be the ratchetting action of the hand hold and the same ratchetting action of the hand hold in combination with an auxiliary "handle in ratchet connection with the shank." Such a tool is fairly complex, having several moving parts. A simpler and more versatile tool would be desirable.

It is therefore an object of this invention to provide a D-handled wrench for applying torque to a socket drive adapted to engage socket wrenches and attachments therefor, wherein said D-handled wrench and shaft provides for the applying of torque thereto by various means, among them:

direct action of at least one hand gripping said handgrip of said handle;

action of two hands, one on each side of said loop;

direct action of at least one hand thrust through the loop of said handle and gripping the hub thereof and elements of said loop;

action of at least one hand via a bar means thrust through an axial hole in the handgrip of said handle;

action of at least one hand via bar means thrust through the loop of said handle;

action of at least one hand via notched bar means thrust through the loop of said handle;

action of at least one hand via a socket drive wrench in an axial hole in the hub of said wrench; and action of at least one hand via a wrench on flat surfaces of the axial shaft of said wrench.

DETAILED DESCRIPTION OF THE INVENTION

This invention will be best understood by referring to the attached drawings wherein like reference numbers identify the same part throughout the figures.

Figure 1:
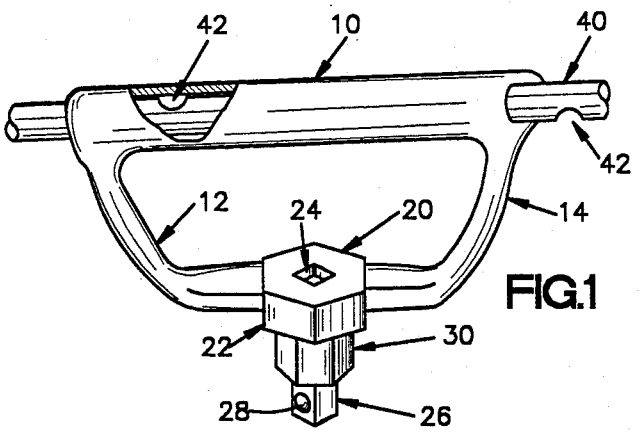
FIG. 1 is a perspective view of the wrench of this invention with a torque bar thrust through the axial hole in the hand-grip position of the wrench.
Figure 2:
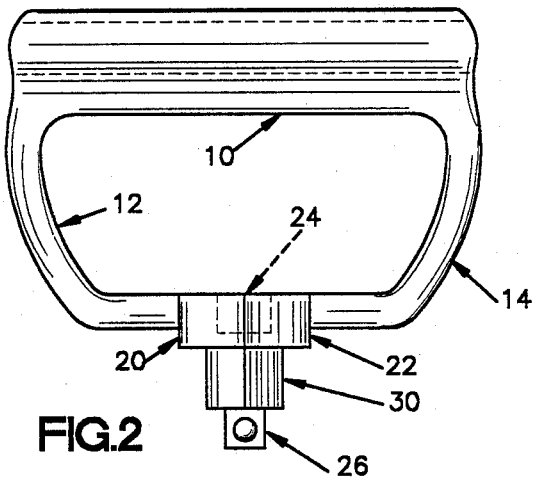
FIG. 2 is a plan view of the wrench of this invention.

FIG. 1 illustrates the wrench of this invention, comprising: a D-shaped handle, which handle comprises a hollow hand-grip 10 and loop elements 12 and 14 integral with said hand-grip; a hub element 20 to which said loop elements 12 and 14 are attached, which hub element comprises a first shaft portion 22 having flats for engaging by means of a wrench and an axial socket 24 for engaging by means of a standard socket drive tool or torque bar and a second shaft portion 26 adapted as a male element for engaging standard sockets or attachments therefor and which may optionally include a spring and ball device 28 for retaining said sockets or attachments. Also shown in the figures is an optional third shaft portion 30 smaller than the first shaft portion, interposed between said first shaft portion and second shaft portion and having flats for engaging by means of one or more box, adjustable, or open-end wrenches.

Normal use of the wrench of this invention would comprise the gripping of the handgrip 10 by the user for applying a twisting motion with the wrist to impart torque to the wrench and thereby to the shaft thereof. Of special importance in normal use is that pure torque may be applied by the axial rotation of the wrench with no transverse forces transmitted by the handle to the hub portion and driving end of the tool; axial force may be optionally applied along with the torque.

FIG. 1 also shows a notched torque bar 40, of this invention, which is specifically adapted to be used in combination with this invention and may be used therewith in several manners. As shown in FIG. 1, the torque bar 40 or other torque bar may be slidably inserted through the axial hole in the handgrip 10. The torque bar 40 or other torque bar could also be passed through the large loop opening defined by the handgrip 10, loop elements 12 and 14, and the hub element 20. In either position, said torque bar would, by the principles of levers, increase the usable torque for tightening or loosening bolts, nuts, or the like (i.e., the same force applied to the longer lever arm results in greater torque). In this mode of operation also, as in the normal mode of operation, pure torque may optionally be applied by the handle to the hub portion and driving end of the tool by balancing the applied forces of two hands on the torque bar, using it as a T-handle type torque bar; axial force may also be applied in this T-handle configuration. Where one hand only is used on the torque bar, the handle portion of the tool is usually supported by the other hand to balance the transverse forces and generate a resultant torque; axial force may also be applied by the second hand.

The specific advantage in using the specific torque bar 40, which is notched to cooperatively engage the loop elements 12 and 14 of the handle, lies in the fact that the notches 42, being cylindrical in shape and precicely spaced on opposite sides of the bar, prevent rotation of the torque bar on its longitudinal axis as might otherwise happen as a torque is applied to it to turn the wrench handle.

More than one torque bar could be used, each of which may be passed through said large opening, or one of which is passed through said axial hole in the handgrip 10.

Another means for applying additional torque to the wrench of this invention is by means of the flat surfaces on first shaft portion 22. Any convenient adjustable or fixed-jaw wrench, as an open-end wrench could be used. Also, this first shaft portion 22 extends sufficiently below the attachment of loop elements 12 and 14 to allow the use of a closed wrench as a box end wrench to be used advantageously on this first shaft portion if it is made with four or six substantially equilateral flats in the shape of a square or hexagon.

The first shaft portion is also provided on its end face with a square socket adapted for engaging with a square drive wrench of the type commonly used with interchangeable sockets. Such a wrench, though not a part of this invention, may be used to apply added torque to the shaft of the wrench of this invention.

Figure 3:
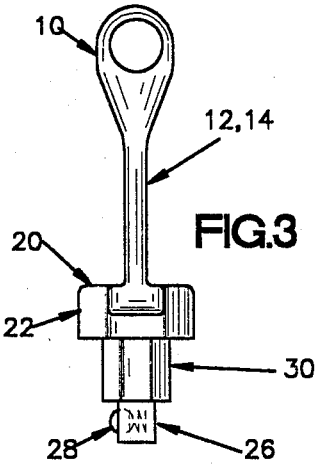
FIG. 3 is a side view of the wrench of this invention.

The second shaft portion 26 is adapted as a male element for engaging standard sockets or attachments therefor. It is shown in FIG. 3 to include an optional ball and spring mechanism 28 common to such wrenches for retaining sockets or attachments.

The optional third shaft portion 30 has flats to allow gripping thereof with any convenient adjustable or fixed-jaw wrench, either open- or closed-ended. The diameterical dimension of the third shaft portion is smaller than that of the first shaft portion to allow a wrench suited for the first shaft portion to easily pass over the third shaft portion for engagement with the first shaft portion. The length of third shaft portion 30 is sufficient to provide adequate gripping thereof by two such wrenches that may be similar wrenches or wrenches of different types.

Inspection of the figures will show that in the best mode the majority of the weight of the wrench is in the handgrip 10 and the two loop elements 12 and 14. This weight distribution is no accident, for the natural balance of the wrench is thereby made to provide convenience for the user who is working on a fastener overhead, as a mechanic working under an automobile. By thrusting his fingers through the large loop with his palm upward (toward the hub 20) and the back of his hand toward the handgrip 10, the natural balance of the wrench keeps the shaft portions in a generally upward orientation so the fingers may grasp the hub 20 and portions of the loop elements 12 and 14 for the applying of torque to the shaft, while the weight of the wrench rests in the palm of the hand, through which axial force on the shaft may be applied if necessary. Although, the amount of torque that can be applied in this manner may be limited, the convenience of the wrench used in this manner for initially engaging threads in an overhead location is a decided advantage of the wrench of this invention over any other type of wrench.

Figure 4:
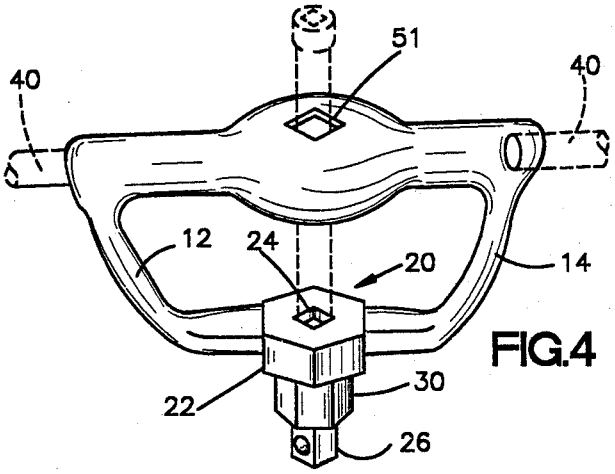
FIG. 4 is a perspective view of an alternative embodiment of the wrench of this invention.

An embodiment that comprises an optional feature is shown in FIG. 4. From experimental use it has been found that greater comfort in gripping and ease in operating the wrench of the present invention is attained if the handgrip portion of the handle includes an expanded bulbous section as shown in FIG. 4. An added optional benefit may then be added in a wrench having this construction by providing a hole 51 through the bulbous handgrip in axial alignment with the shaft portion of the wrench 20 and the square drive socket 24 optionally provided in the end face thereof, which hole shall be large enough in diameter to accomodate a standard socket extension that may cooperatively engage said square drive socket 24. In this arrangement, a socket wrench can be used to drive the shaft of this invention by means of this socket extension in combination with torques otherwise applied as described herein. Furthermore, whether such an auxiliary socket drive wrench is used, the socket extension or other elongated socket-engaging tool may be used as a leverage point in combination with various torque bars or pry bars engaging the loop elements of the wrench handle to more centrally apply the torque to drive the wrench. Such use could also employ the notched torque bar 40.

While there is shown and described herein certain specific structures embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A torque-transmitting tool adapted for use with standardized interchangeable sockets for engaging the heads of threaded fasteners, such as screws, bolts, and nuts, for examples, which tool comprises:

a substantially cylindrical hand-grip portion;

a hub portion;

and two loop elements, each interconnecting one end of said hand-grip portion to a respective side of said hub portion in such orientation that said hand-grip portion and said loop elements form a "D"-shape with said hub portion centrally located on the curved portion of the "D" and said hand-grip portion forming the straight portion of the "D";

said hub portion comprising:

a rigid shaft extending in a direction substantially away from said hand-grip portion along an axis substantially perpendicular to the axis of said hand-grip portion and about which shaft axis said hub is not free to rotate relative to said hand-grip portion owing to the attachment to the loop elements;

a first shaft portion of said shaft having on the periphery thereof at least two flat surfaces for engagement thereof by a wrench;

a second shaft portion of said shaft adapted as a male element for engaging standard socket wrenches and attachments therefor and which may include means for retaining said socket wrenches and attachments;

and a third shaft portion smaller than said first shaft portion and having on its periphery at least two flat surfaces on diametrically opposite sides thereof for engagement thereof by means of one or more wrenches, said third shaft portion is interposed between said first shaft portion and said second shaft portion;

wherein said first shaft portion also comprises an axial socket on the end face thereof proximal said hand-grip portion for engagement of said shaft by a drive tool not of this invention, such as a standard socket drive tool, Allen wrench, spline wrench, or torque bar therefor adapted, for examples.

2. The tool of claim 1, wherein said hand-grip portion comprises an open-ended hollow cylindrical handle adapted to receive axially through the hollow thereof an elongate bar for the applying of torque to the tool by means of said elongate bar.

3. The tool of claim 1, wherein said loop elements are fixedly attached to said hub portion.

4. The tool of claim 1 in combination with a notched elongate torque bar, said torque bar being characterized by having at least one pair of notches therein, said notches being characterized as being in the shape of cylindrical sectors and being positioned on opposite sides of said bar at a distance exactly matching the distance between loop elements of said tool and adapted to cooperatively engage said loop elements, thereby to prevent slipping of the bar on said loop elements and therby to prevent twisting of said torque bar when force is applied thereto.

5. A torque-transmitting tool adapted for use with standardized interchangeable sockets for engaging the heads of threaded fasteners, such as screws, bolts, and nuts, for examples, which tool comprises:

a cylindrical hand-grip portion having a bulbous central portion;

a hub portion;

and two loop elements, each interconnecting one end of said hand-grip portion to a respective side of said hub portion in such oreintation that said hand-grip portion and said loop elements form a "D"-shape with said hub portion centrally located on the curved portion of the "D" and said hand-grip portion forming the straight portion of the "D";

said hub portion comprising:

a rigid shaft extending in a direction substantially away from said hand-grip portion along an axis substantially perpendicular to the axis of said hand-grip portion and about which shaft axis said hub is not free to rotate relative to said hand-grip portion owing to the attachment to the loop elements;

a first shaft portion of said shaft having on the periphery thereof at least two flat surfaces for engagement thereof by a wrench;

and a second shaft portion of said shaft adapted as a male element for engaging standard socket wrenches and attachments therefor and which may include means for retaining said socket wrenches and attachments;

wherein said first shaft portion also comprises an axial socket on the end face theroef proximal said hand-grip portion for engagement of said shaft by a drive tool not of this invention, such as a standard socket drive tool, Allen wrench, spline wrench, or torque bar therefor adapted, for examples;

and wherein said bulbous handgrip portion also includes a hole therethrough sufficiently large to allow passage of a common straight extension drive member adapted to fit said axial socket on the end face of said first shaft portion and engaging the same while extending through said bulbous hand-grip portion.

6. The tool of claim 5, wherein said hub portion also comprises a third shaft portion smaller than said first shaft portion and having on its periphery at least two flat surfaces on diametrically opposite sides thereof for engagement thereof by means of one or more wrenches, which third shaft portion is interposed between said first shaft portion and said second shaft portion.

7. The tool of claim 5, wherein said bulbous hand-grip portion includes a transverse hole therethrough adapted to receive axially through the hollow thereof an elongate bar for the applying of torque to the tool by means of said elongate bar.

8. The tool of claim 5, wherein said hub portion also comprises a third shaft portion smaller than said first shaft portion and having on its periphery at least two flat surfaces on diametrically opposite sides thereof for engagement thereof by means of one or more wrenches, which third shaft portion is interposed between said first shaft portion and said second shaft portion.

9. The tool of claim 5, wherein said loop elemnts are fixedbly attached to said hub portion.

10. The tool of claim 5 in combination with a notches elongate torque bar, said torque bar being characterized by having at least one pair of notched therein, said notches being characterized as being in the shape of cylindrical sectors and being positioned on opposite sides of said bar at a distance exactly matching the distance between loop elements of said tool and adapted to cooperatively engage said loop elements, thereby to prevent slipping of the bar on said loop elements and thereby to prevent twisting of said torque bar when force is applied thereto.

* * * * *